United States Patent [19]

Wilson et al.

[11] 4,416,119

[45] Nov. 22, 1983

[54] VARIABLE CAPACITY BINARY REFRIGERANT REFRIGERATION APPARATUS

[75] Inventors: Raymond G. Wilson; Edwin H. Frohbieter, both of Lincoln Township, Berrien County, Mich.

[73] Assignee: Whirlpool Corporation, Benton Harbor, Mich.

[21] Appl. No.: 338,581

[22] Filed: Jan. 8, 1982

[51] Int. Cl.[3] ..... F25B 41/00; F25B 17/00

[52] U.S. Cl. ..... 62/149; 62/174; 62/180; 62/186; 62/196.1; 62/502; 62/513

[58] Field of Search ..... 62/198, 526, 228 C, 62/228 B, 229, 196 A, 196 R, 114, 502, 149, 174, 197, 113, 186, 513, 203, 216, 180

[56] References Cited

U.S. PATENT DOCUMENTS

| | | | |
|---|---|---|---|
| 2,255,584 | 9/1941 | Hubacker | 62/76 |
| 2,260,825 | 10/1941 | Blood | 62/445 |
| 2,277,138 | 3/1942 | Newton | 62/93 |
| 2,296,304 | 9/1942 | Wolfert | 62/229 X |
| 2,405,392 | 8/1946 | Atchison | 62/334 |
| 2,483,842 | 10/1949 | Philipp | 62/444 |
| 2,667,757 | 2/1954 | Shoemaker | 62/441 X |
| 2,682,756 | 7/1954 | Clark et al. | 62/335 |
| 2,794,322 | 6/1957 | Etherington | 62/114 |
| 2,794,328 | 6/1957 | Herrick | 62/114 |
| 2,794,329 | 6/1957 | Herrick | 62/114 |
| 2,799,142 | 7/1957 | Schubert et al. | 62/114 |
| 2,841,965 | 7/1958 | Etherington | 62/513 |
| 2,867,094 | 1/1959 | Herrick | 62/174 |
| 2,867,099 | 1/1959 | Schubert | 62/502 |
| 2,937,512 | 5/1960 | Etter | 62/196 R |
| 2,938,362 | 5/1960 | Schwind | 62/114 X |
| 3,019,614 | 2/1962 | Schubert et al. | 62/114 |
| 3,359,751 | 12/1967 | Stevens | 62/441 X |
| 4,179,898 | 12/1979 | Vakil | 62/114 |

OTHER PUBLICATIONS

Lorenz et al., *An Application of Non-Azeotropic Two--Component Refrigerants in Domestic Refrigerators and Home Freezers,* XIV International Refrigeration Congress, Moscow 1975.

*Primary Examiner*—Albert J. Makay
*Assistant Examiner*—Harry Tanner
*Attorney, Agent, or Firm*—Wood, Dalton, Phillips, Mason & Rowe

[57] ABSTRACT

A variable capacity binary refrigerant refrigeration apparatus providing improved energy usage efficiency in an operation of a dual evaporator system. One evaporator is used for refrigerating an above-freezing fresh food zone and the other evaporator is used for refrigerating a below-freezing freezer zone. The fluid system includes a rectifier, a separator, and an auxiliary condenser, together with suitable valves for controlling the operation of the apparatus. The system further utilizes control of the cold air circulating fans in effecting the desired improved operation.

22 Claims, 4 Drawing Figures

LOAD INTRODUCED TO FREEZER ZONE

LOAD INTRODUCE TO FRESH FOOD ZONE

VARIABLE CAPACITY BINARY REFRIGERANT REFRIGERATION APPARATUS

BACKGROUND OF THE INVENTION

1. Field of the Invention

This invention is concerned with refrigeration apparatus and in particular to means for improving the energy usage efficiency of a binary refrigerant refrigeration system utilizing a refrigerant flow circuit including heat exchangers in the below-freezing and above-freezing zones.

2. Description of the Background Art

In a paper presented before the International Refrigeration Congress in Moscow, Russia, in 1975, A. Lorenz and K. Meutzner describe a non-azeotropic two-component refrigerant domestic refrigerator-home freezer system. As shown in FIG. 4 of the publication, it was known, in 1975, to provide a refrigeration apparatus having a first evaporator in the freezer zone and a second evaporator in the above-freezing zone of a refrigerator, with a first heat exchanger between the condenser and the freezer evaporator, and a second heat exchanger between the freezer evaporator and the above-freezing compartment evaporator. The refrigerant comprised a binary refrigerant of R 22/R 11 composition.

Another binary refrigerant system is illustrated in U.S. Pat. No. 2,799,142 of Albert E. Schubert et al. for providing dual temperature levels of refrigeration in the system. The refrigerant components in the Schubert et al patent comprise Freon 22 and Freon 12. The system is arranged for selectively circulating one of the refrigerants, substantially purging the system of that refrigerant, and circulating the other refrigerant through the system, while purifying the first refrigerant during the circulation of the other refrigerant. The means for purifying the refrigerant comprises distilling means.

SUMMARY OF THE INVENTION

The present invention comprehends an improved variable capacity binary refrigerant refrigeration apparatus which provides improved energy usage efficiency.

The refrigerant of the present invention is advantageously adapted for use with domestic refrigerator/-freezer apparatuses. The system provides separate freezer and above-freezing compartment refrigeration, with continuously variable refrigeration capacity upon demand. The system is arranged to provide continuous operation, thereby reducing losses due to cycling as in conventional refrigerators.

The improved apparatus operates automatically to shift the refrigeration capacity between the freezer zone and the fresh food zone as a function of the demand.

The refrigeration apparatus of the present invention functions automatically to balance the load pursuant to the demand of the two different zones. When the system operates in a normal environment with the load on the system being due to the thermal leakage of the refrigerator cabinet, the binary refrigerant is selected to provide a maximum coefficient of performance (COP). Under this condition, the refrigeration system runs continuously, thereby eliminating losses due to cycling.

The apparatus includes means for establishing preset temperatures and sensing means for determining the actual temperature of the freezer zone and the above-freezing zone, and comparing them with the preset temperatures. The control operates so that as long as the preset temperature and the actual temperature in the refrigerator and freezer zones are within the preset limits, the binary refrigerant is delivered from the condenser through a rectifier without change in the ratio of the constituent refrigerant fluids therein. Under these conditions, the refrigerant mixture flows through the two heat exchangers connected in the refrigerant flow circuit.

The system is arranged so that if the temperature in the fresh food zone rises above a preselected temperature while the freezer temperature remains below a preselected temperature, a valve bypassing the second heat exchanger opens so as to bypass liquid refrigerant around said second heat exchanger directly to the expansion means of the system, thereby rendering the second heat exchanger ineffective so that the refrigerant leaving the freezer evaporator is cold and of low quality vapor as it enters the fresh food evaporator. The first heat exchanger, which is located in the refrigerator zone, superheats the refrigerant delivered from the fresh food evaporator before it is returned to the compressor.

Normally, under the condition of the freezer being below the preset temperature, the freezer fan is de-energized. As a result of the bypassing of the second heat exchanger located in the freezer zone and the de-energization of the fan, the refrigeration effect is shifted to the fresh food zone.

As a result of the de-energization of the freezer fan and the delivery of the refrigerant in bypassed relationship to the second heat exchanger, the temperature in the freezer zone slowly drifts upwardly. If the fresh food zone reaches the desired low temperature before the freezer zone reaches a preselected elevated temperature, the system is returned to the normal operation with the bypass valve closed.

Alternatively, the invention comprehends the control of the system to shift capacity to the freezer zone, such as when a sudden load is added thereto, causing the temperature to reach a preselected high temperature. Thus, more of the available cooling effect will be available in the freezer to increase the refrigeration thereof. In the event the temperature of the freezer continues to rise notwithstanding the shutting down of the fresh food fan, the refrigeration capacity of the system is increased while maintaining the shift to the freezer.

The invention comprehends the increasing of the system capacity by heating a portion of the binary refrigerant to boil off the lower boiling point constituent fluid, condensing the boiled-off fluid, and introducing the condensed boiled-off fluid to the binary refrigerant being circulated to the evaporators. The rate of heating is controlled so as to be proportional to the slope of the temperature/time curve.

When the temperature conditions in the freezer and fresh food zones reach the desired low temperature conditions, the system is returned to the normal operating conditions wherein the binary refrigerant is flowed through the series arrangement of the heat exchangers and evaporators.

The heating of a portion of the binary refrigerant to provide the increased amount of low boiling temperature refrigerant to the refrigerant fluid being circulated through the evaporator is effected in a rectifier. Suitable valves are provided for controlling delivery selectively from the rectifier or from a separator receiving the condensed boiled-off low temperature refrigerant.

Control of the valves and fan motors may be effected by any suitable means as desired.

Thus, the refrigeration apparatus of the present invention is extremely simple and economical of construction while yet providing a highly improved self-balancing, high energy usage efficient system in a two-zone binary refrigerant apparatus.

BRIEF DESCRIPTION OF THE DRAWING

Other features and advantges of the invention will be apparent from the following description taken in connection with the accompany drawing wherein.

DESCRIPTION OF THE PREFERRED EMBODIMENT

Figure 1:
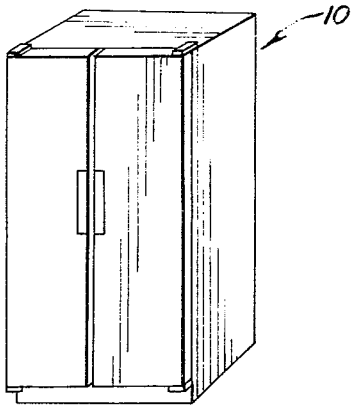
FIG. 1 is a perspective view of refrigeration apparatus having a refrigerant system embodying the invention.

In the illustrative embodiment of the invention as disclosed in the drawing, a refrigeration apparatus generally designated 10 is shown to comprise a domestic refrigerator having an outer cabinet 11 with internal wall means 12 for dividing the interior space of the cabinet into a freezer zone 13 and a fresh food zone 14. The freezer zone is defined by a space effectively maintained at a below-freezing temperature and the fresh food zone is defined by a space effectively maintained at a refrigerated above-freezing temperature.

The invention comprehends the provision of means for providing a binary refrigerant in the refrigeration system generally designated 15, including a conventional compressor 16 and a conventional condenser 17. The compressor and condenser may be provided in a machinery space 18 within the outer cabinet 11. In the illustrated embodiment, the refrigeration apparatus defines a side-by-side unit wherein the freezer and fresh food zones are in side-by-side relationship with the machinery space 18 disposed therebelow.

Figure 2:
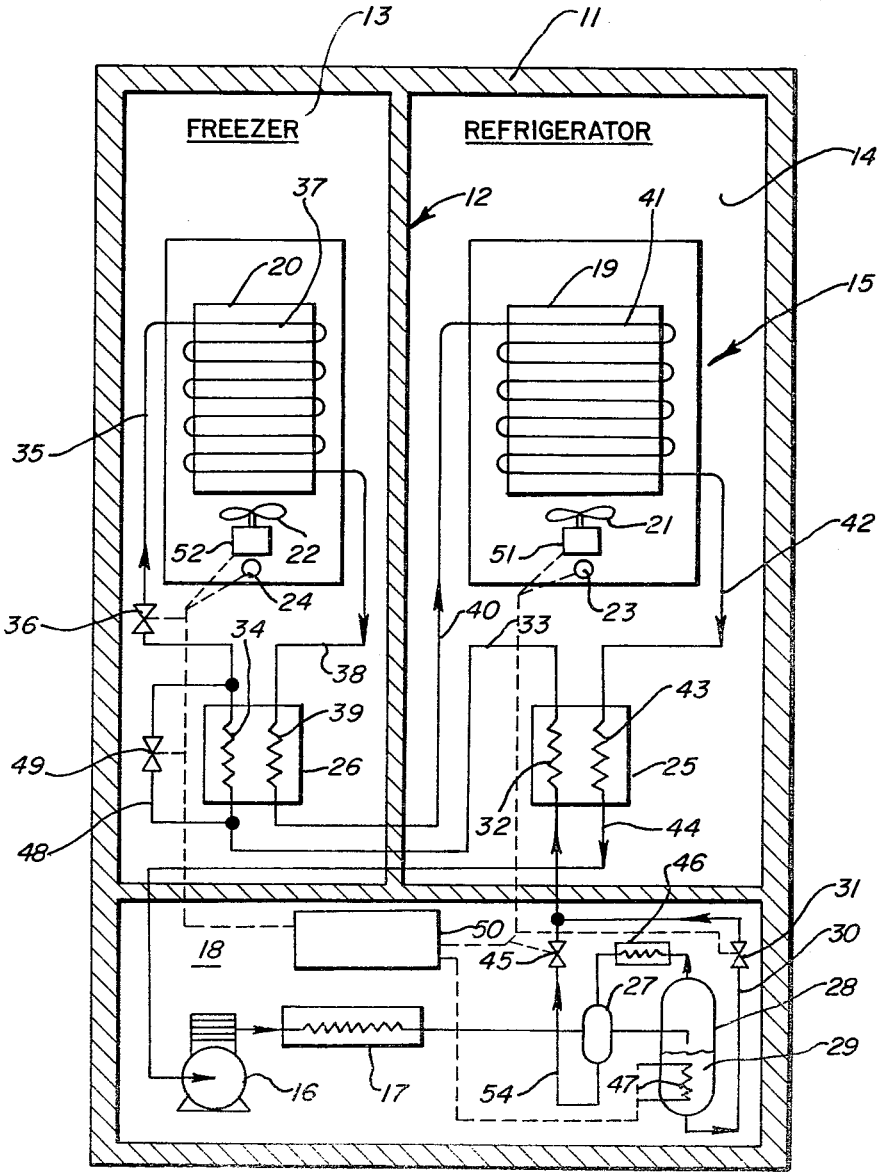
FIG. 2 is a schematic vertical section illustrating the refrigerant flow circuitry of the invention.

As illustrated in FIG. 2, a first evaporator 19 is disposed in the fresh food zone 14 and a second evaporator 20 is disposed in the freezer zone 13. Air moving means are provided for circulating cooling air through the zones 13 and 14, and as shown, include a first fan 21 for circulating air in heat exchange relationship with evaporator 19 to the fresh food zone 14, and a second fan 22 for circulating air in heat exchange relationship to the freezer evaporator to the freezer zone 13.

A temperature sensor 23 is disposed adjacent fan 21 for sensing the average temperature in fresh food zone 14 and a temperature sensor 24 is disposed adjacent fan 22 for sensing the average temperature in the freezer zone 13.

A first heat exchanger 25 is provided in fresh food zone 14 and a second heat exchanger 26 is provided in freezer zone 13, as seen in FIG. 2.

Condensed binary refrigerant is delivered from condenser 17 through a separator 27 to a rectifier 28. The binary refrigerant liquid 29 is delivered through a conduit 30 provided with a shutoff valve 31 to an inlet conduit 32 of the heat exchanger 25. The binary refrigerant fluid is delivered from conduit 32 through a transfer conduit 33 to an inlet conduit 34 of heat exchanger 26, and through a transfer conduit 35 having an expansion valve 36 to the evaporator coil 37 of evaporator 20.

The binary refrigerant may advantageously be comprised of a non-azeotropic refrigerant mixture of R 12/R 11. It is important to select the binary refrigerant mixture which will match the temperature profile of the air crossing the evaporator and condenser during normal operation in order for the system to operate at a high COP. Yet the refrigerant pair must also be such that a substantial difference in density at the compressor suction can be made to occur by adjusting the refrigerant mixture ratio in order to increase refrigeration capacity of the system upon demand. Other non-azeotropic refrigerant mixtures which may advantageously be employed in the disclosed apparatus and system are R 22/R 114 and R 22/R 11.

From evaporator coil 37, the binary refrigerant is delivered through a transfer conduit 38 to the outlet conduit 39 of heat exchanger 26, which is in heat transfer association with the inlet conduit 34 thereof.

From outlet conduit 39 of heat exchanger 26, the refrigerant is delivered through a transfer conduit 40 to the coil 41 of evaporator 19. From evaporator coil 41, the refrigerant is delivered through a transfer conduit 42 to an outlet conduit 43 of heat exchanger 25 in heat exchange relationship with the inlet conduit 32 thereof. The refrigerant is returned from outlet conduit 43 of heat exchanger 25 through a transfer conduit 44 to compressor 16 for recompression and recirculation through the system.

Separator 27 is connected through a conduit 54 having a shutoff valve 45 to the first heat exchanger inlet conduit 32. An auxiliary condenser 46 is connected between an upper portion of the rectifier 28 and an upper portion of the separator 27. A heating coil 47 is provided for heating the refrigerant liquid 29 in rectifier 28.

A bypass conduit 48 is connected in parallel with inlet conduit 34 of heat exchanger 26 and is provided with a shutoff valve 49.

The refrigeration apparatus includes a suitable control 50, which may be of any conventional construction, for controlling the operation of fan motors 51 and 52 for driving fans 21 and 22, respectively, valves 31, 36, 45 and 49, and heater 47 as a function of the temperature sensed by sensors 23 and 24 in the zones 13 and 14. Illustratively, the control may comprise a Texas Instruments Model TMS7040 microprocessor wherein a number of set points may be stored in the memory thereof for constant comparison with the temperature sensed by sensors 23 and 24. In the illustrated embodiment, these temperatures may be sensed every two seconds by the control 50 so that whenever measured temperatures are outside the present limits set into the control, suitable associated switches (not shown) are actuated for controlling operation of the respective fan motors, valves, and heater for shifting the refrigerant system capacity or increasing the total system capacity, as will be brought out more fully hereinafter.

Figure 4:
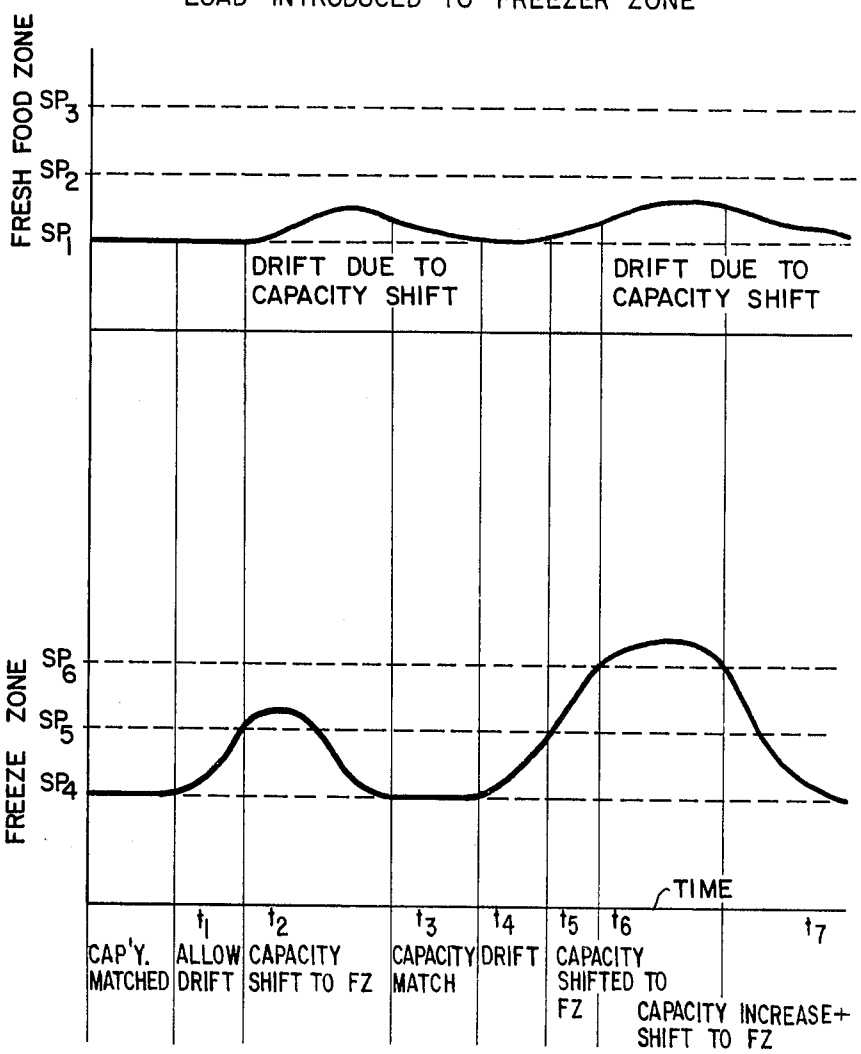
FIG. 4 is a graph similar to that of FIG. 3 but illustrating the temperature conditions in the fresh food and freezer zone as a result of a load introduced to the freezer zone.
Figure 3:
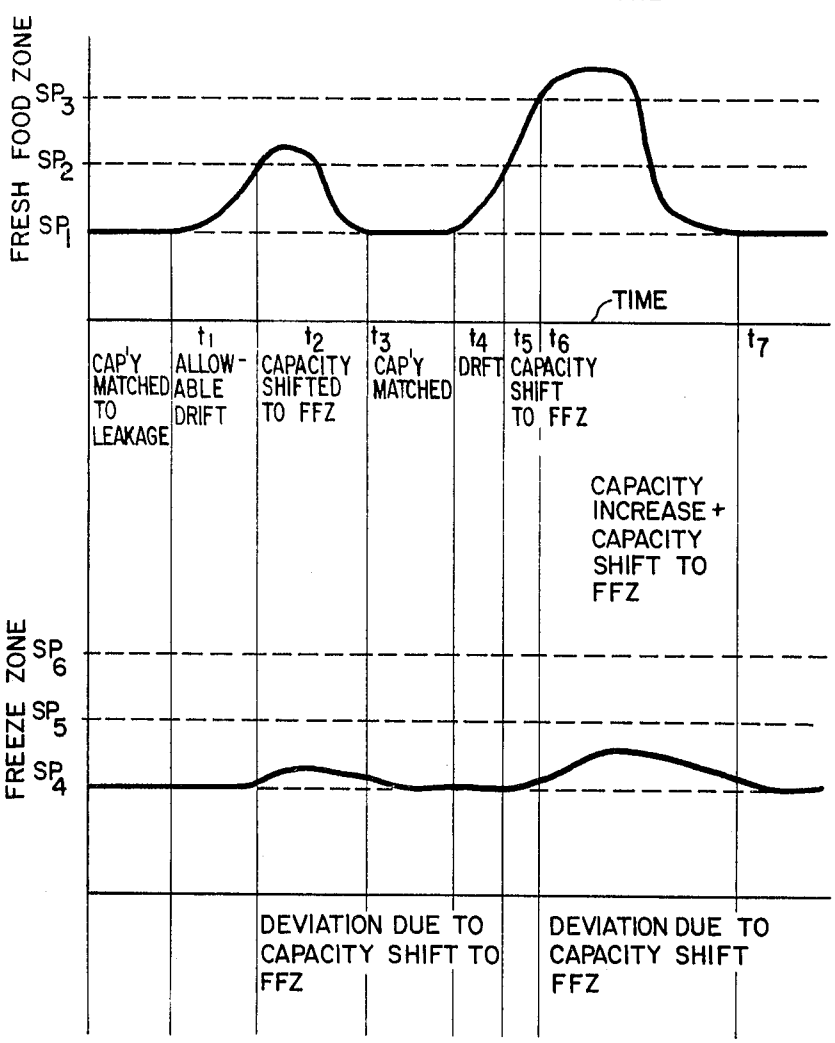
FIG. 3 is a graph illustrating the temperature conditions in the fresh food zone and freezer zone as a result of a load introduced to the fresh food zone.

As shown in FIGS. 3 and 4, control 50 may be set to define six preset temperature set points SP1, SP2, SP3, SP4, SP5 and SP6. Set points SP1, SP2 and SP3 are compared continuously with temperature signals received from fresh food zone sensor 23 and set points SP4, SP5 and SP6 are compared continuously with temperature signals received from freezer zone sensor 24.

FIG. 3 illustrates graphically the operation of the refrigeration system where the temperature in the fresh food zone 14 increases to and beyond the different set points SP1, SP2 and SP3, and illustrates the corresponding small changes in the freezer zone temperature. FIG. 4 illustrates the substantial changes in the temperature within the freezer zone as a result of the load introduced therein relative to the set points SP4, SP5 and SP6, and the relatively small changes that concurrently occur in the temperature within the fresh food zone.

As pointed out above, the refrigeration system is arranged to run continuously so as to eliminate losses due to cycling, as in the conventional refrigeration systems. Referring now to FIGS. 2 and 3, as long as the temperature within the fresh food compartment 14 sensed by sensor 23 remains below SP2, the system is arranged to provide the binary refrigerant liquid 29 from rectifier 28 to the refrigerant circuit 15. Thus, at this time, valve 31 is open, valve 45 is closed, and valve 49 is closed to permit the normal flow of the binary refrigerant successively through the heat exchangers 25 and 26 and evaporators 19 and 20. The binary refrigerant is selected so as to provide under these conditions the optimum coefficient of performance, i.e. COP.

However, if the temperature in the fresh food zone 14 rises above the set point SP2 of control 50, with the temperature in the freezer zone 13 remaining below set point SP5, control 50 causes valve 49 to open so as to bypass warm liquid refrigerant around inlet conduit 34 of heat exchanger 26 directly to the expansion valve 36. (In the illustrated embodiment, the expansion means comprises expansion valve 36, it being obvious to those skilled in the art that any suitable orifice or capillary tube may be utilized for this purpose.)

As the bypassing of the conduit 34 renders heat exchanger 26 ineffective to warm the refrigerant passing outwardly through conduit portion 39 thereof, the refrigerant remains cold and is of a low quality vapor as it enters the fresh food evaporator coil 41. The refrigerant delivered from coil 41 through heat exchanger conduit 43 is superheated by the refrigerant passing through inlet conduit 32 in heat exchange relationship therewith and, thus, is delivered to the compressor as superheated refrigerant. Resultingly, the capacity of the system is shifted from the freezer zone to the fresh food zone as a result of controlling the amount of subcooling at the expansion device 36. As a result, as seen in FIG. 3, the temperature in the fresh food zone 14 will normally drop to below set point SP2 back to the lower set point SP1. At the same time, a slight rise in the temperature in the freezer zone 13 occurs. Assuming that this operation is sufficient to handle the heat introduced into the fresh food zone, the system then continues to operate with the capacities matched at the preselected set points SP1 and SP4.

When the freezer zone temperature is at the preselected operating set point SP4, which illustratively may be 0° F., the control causes the freezer fan motor 52 to be de-energized. With the valve 49 bypassing the warm refrigerant liquid around the heat exchanger so as to cause the refrigerant passing through heat exchanger conduit 39 to not be warmed, and concurrently minimizing heat transfer from the evaporator coil 37, the refrigeration effect is shifted to the fresh food zone.

If, however, the temperature in the fresh food zone continues to rise, notwithstanding this shift in the refrigeration effect thereto, the capacity of the refrigeration system is increased while maintaining this shift condition. More specifically, the capacity of this system is increased by energization of heater 47 so as to boil off from the liquid refrigerant 29 in rectifier 28 the lower temperature boiling component thereof. The boiled-off refrigerant component is condensed by auxiliary condenser 46 and introduced into the binary refrigerant in separator 27 for delivery through the conduit 54 to the refrigerant circuit 15. In effecting this capacity increase, valve 31 is closed and valve 45 is opened concurrently with the energization of heater 47. As will be obvious to those skilled in the art, the energy input by heater 47 may be caused to be directly proportional to the slope of the temperature versus time curve of the system. Thus, as seen in FIG. 3, the increased capacity of the refrigeration system, together with the shift of the refrigeration effect to the fresh food zone 14 will cause the temperature in the fresh food zone to decrease back to the set point SP1. Concurrently, the temperature of the freezer zone, while rising slightly during these conditions, will again be brought back to the set point SP4.

Thus, the refrigeration system provides an automatic control as a function of the sensed temperatures and the set points of control 50.

Should the freezer zone temperature rise to the set point SP5 temperature as a result of the transfer of refrigeration effect to the fresh food zone, even though the temperature of the fresh food zone does not reach the set point SP3 temperature, the control similarly causes the above described increases in the capacity of the system by energization of heater 47 to bring the operating temperatures back to the set points SP1 and SP4.

Referring now to FIG. 4, a reverse operation of the automatic control system occurs when a heat load is introduced to the freezer zone 13. Thus, as shown in FIG. 4, when the temperature sensed by sensor 24 rises above the set point temperature SP5 while the temperature in the fresh food zone 14 remains below set point temperature SP2, the refrigeration effect is shifted to the freezer zone by de-energizing the fresh food zone fan motor 51, thereby shifting the refrigeration capacity to the heat exchanger 25 and increasing the refrigeration capacity available to evaporator 20. As shown in FIG. 4, if the shift in refrigeration capacity is sufficient to return the temperature in the freezer zone 13 to the set point SP4 temperature, the system will be returned to the original operating condition, as discussed above.

However, should the temperature in the freezer zone 13 continue to move upwardly so as to reach set point SP6, the system capacity is increased by the above described energization of heater 47 and provision of low boiling point refrigerant to the binary refrigerant delivered to the refrigerant circuit 15.

Control 50 functions to cause valve 49 to be closed whenever the temperature in the freezer zone 13 exceeds the set point temperature SP6 concurrently with the temperature in the fresh food zone 14 exceeding the set point temperature SP3.

Thus, the refrigerant system 15 provides an automatic control of the refrigerant flow so as to effect a shifting of the refrigeration effect to whichever of the zones requires such shifting, and to provide additional capacity in the event such shifting is insufficient to return the temperature of the elevated temperature zone to the desired normal operating temperature. The control effects this automatic shifting and capacity increase as a function of the temperatures sensed in the fresh food and freezer zones and the comparison thereof with preselected temperatures set into the control.

The foregoing disclosure of specific embodiments is illustrative of the broad inventive concepts comprehended by the invention.

We claim:

1. In a refrigeration apparatus having means defining a below-freezing refrigerated zone and an above-freezing refrigerated zone, means for providing binary refrigerant to said zone for refrigerating said zone including a compressor and a condenser, a first evaporator in heat transfer association with said below-freezing refrigerated zone, a second evaporator in heat transfer association with said above-freezing refrigerated zone, a first heat exchanger, a second heat exchanger, and refrigerant flow conduit means providing a flow circuit successively through said first heat exchanger, said second heat exchanger, said first evaporator, said second heat exchanger in heat exchange relationship with the refrigerant flowing therethrough to said first evaporator, said second evaporator, and said first heat exchanger in heat exchange relationship with the refrigerant flowing therethrough to said second heat exchanger, to said compressor, the improvement comprising:

bypass means for causing the refrigerant to bypass said second heat exchanger as an incident of the temperature in said above-freezing zone rising above a preselected temperature and the temperature in said below-freezing zone remaining below a second preselected temperature.

2. The refrigeration apparatus of claim 1 wherein said bypass means comprises a bypass conduit connected in parallel with said second heat exchanger, and a valve controlling refrigerant flow therethrough.

3. The refrigeration apparatus of claim 1 further including air flow means for passing cooling air in heat exchange relationship with said first evaporator and to said below-freezing zone, and means for causing said air flow means to be inoperative when said bypass means is causing the refrigerant to bypass said second heat exchanger.

4. The refrigeration apparatus of claim 1 further including first air flow means for passing cooling air in heat exchange relationship with said first evaporator and to said below-freezing zone, and means for causing said first air flow means to be inoperative when said bypass means is causing the refrigerant to bypass said second heat exchanger, and second air flow means for passing cooling air in heat exchange relationship with said second evaporator and to said above-freezing zone, said second air flow means being operated concurrently with the bypassing of the second heat exchanger and inoperation of the first air flow means to provide transfer of a portion of the cooling effect from the below-freezing zone to the above-freezing zone.

5. The refrigeration apparatus of claim 1 wherein said bypass means comprises a bypass conduit connected in parallel with said second heat exchanger, and a valve controlling refrigerant flow therethrough, and means for terminating the bypassing of said second heat exchanger by said bypass means as an incident of the temperature of said above-freezing zone dropping to said first preselected temperature and the temperature of said below-freezing zone remaining below a second preselected temperature.

6. The refrigeration apparatus of claim 1 further including means for increasing the capacity of the refrigeration system as an incident of the temperature of said above-freezing zone rising above a first preselected high temperature concurrently with the temperature of said below-freezing zone rising above a second preselected high temperature.

7. The refrigeration apparatus of claim 1 wherein the binary refrigerant includes a first refrigerant fluid and a second refrigerant fluid having a boiling temperature lower than that of said first fluid, and means are provided for selectively adjusting the ratio of the second refrigerant fluid to the first refrigerant fluid in the binary refrigerant provided to the heat exchangers in said refrigerant flow conduit means as a function of the temperature condition in at least one of said zones.

8. The refrigeration apparatus of claim 7 wherein said means for selectively adjusting said ratio comprises means for separating a portion of the binary refrigerant, means for heating the separated binary refrigerant to boil off a portion of said second fluid therefrom, means for condensing the boiled-off second fluid, and means for adding the condensed boiled-off second fluid to the binary refrigerant flowed through said flow circuit.

9. The refrigeration apparatus of claim 7 wherein said means for selectively adjusting said ratio comprises a rectifier for separating a portion of the binary refrigerant, means for heating the separate binary refrigerant in said rectifier to boil off a portion of said second fluid therefrom, means for condensing the boiled-off second fluid, and valve means for controlledly adding the condensed boiled-off second fluid to the binary refrigerant flowed through said flow circuit.

10. The refrigeration apparatus of claim 7 wherein said means for selectively adjusting said ratio comprises means for separating a portion of the binary refrigerant, means for heating the separated binary refrigerant to boil off a portion of said second fluid therefrom, means for condensing the boiled-off second fluid, and means for adding the condensed boiled-off second fluid to the binary refrigerant flowed through said flow circuit including a separator for receiving the condensed boiled-off second fluid, and binary refrigerant from said condenser, and means defining a flow passage from said separator to said first heat exchanger.

11. The refrigeration apparatus of claim 7 wherein said means for selectively adjusting said ratio comprises means for separating a portion of the binary refrigerant, means for heating the separated binary refrigerant to boil off a portion of said second fluid therefrom, means for condensing the boiled-off second fluid, and means for adding the condensed boiled-off second fluid to the binary refrigerant flowed through said flow circuit including a separator for receiving the condensed boiled-off second fluid and binary refrigerant from said condenser; means defining a flow passage from said separator to said first heat exchanger; and valve means for controlling delivery of the refrigerant fluid from said separator through said flow passage.

12. In a variable capacity refrigerator/freezer including means forming a fresh food storage compartment, means forming a frozen food storage compartment, and a sealed refrigeration system including a fresh food evaporator, a freezer evaporator, a compressor, a condenser, expansion means, a series of refrigerant conduits connecting said evaporators, compressor, condenser and expansion means into a sealed system, and within said sealed system a binary refrigerant mixture of two nonazeotropic refrigerants having substantially different boiling points, a fresh food heat exchanger including a conduit in series connection with and downstream of said fresh food evaporator, and a freezer heat exchanger including a conduit in series connection with and downstream of said freezer evaporator, said heat exchangers being arranged to transfer heat from the refrigerant mixture in portions of said conduits in series connection with said condenser to portions of the refrigerant in the conduits in series connection with the respective evaporators, the improvement comprising:

a separator having inlet and outlet conduits and connected by an inlet conduit to said condenser and by an outlet conduit to said fresh food heat exchanger;

a rectifier connected by a separator outlet conduit to said separator and by a rectifier outlet conduit to a portion of said fresh food heat exchanger in fluid communication with said separator;

means for establishing set temperatures;

means for sensing the actual temperature within the food storage compartments;

a first valve in said rectifier outlet conduit;

a second valve in said separator outlet conduit connecting said separator to the condenser connected portion of the fresh food heat exchanger;

a bypass conduit around a condenser-communicating portion of said freezer heat exchanger;

a third valve in said bypass conduit; and control means for causing said first valve to be open, and said second and third valves to be closed whenever the set temperatures and the actual sensed temperatures within said food storage compartments are within preset limits, whereby the refrigerant mixture which circulates through said system provides the optimum COP for said refrigerator/freezer.

13. The variable capacity refrigerator/freezer of claim 12 wherein said third valve is opened automatically when the temperature in the fresh food compartment rises above the set point temperature and the temperature in the frozen food compartment remains at the set temperature, whereby warm liquid refrigerant flows through said bypass conduit around said freezer heat exchanger directly to said expansion valve, cooling the refrigerant received by said fresh food evaporator, thereby increasing the refrigeration capacity of the system with respect to said fresh food compartment.

14. The variable capacity refrigerator/freezer of claim 12 further including a motor-driven fan in said fresh food storage compartment, and means for operating said fan to shift refrigeration effect to the fresh food compartment.

15. The variable capacity refrigerator/freezer of claim 12 further including means for increasing the thermal capacity of both of said food compartments comprising a phase change material preselected to lower the temperature drift rate when refrigeration loads are shifted.

16. The variable capacity refrigerator/freezer of claim 12 further including means for shifting capacity from said fresh food compartment to the said freezer compartment comprising means to discontinue operation of said fan on sensing that a sudden load has been added to said freezer zone.

17. The variable capacity refrigerator/freezer of claim 12 further including means for increasing the system capacity whenever the set temperature of each of said food compartments are exceeded at the same time comprising means for closing said third valve on sensing of said condition.

18. The variable capacity refrigerator/freezer of claim 12 further including means for increasing the system capacity comprising a heater in said rectifier and means for operating said heater while said first valve is closed and said second valve is opened until a desired system capacity is reached.

19. The variable capacity refrigerator/freezer of claim 12 further including a second condenser connected between a rectifier outlet conduit connecting to an upper portion of said rectifier and an upper portion of said separator, whereby refrigerant gas generated in said rectifier may be condensed before it enters said separator.

20. In a refrigeration apparatus having means defining a below-freezing refrigerated zone and an above-freezing refrigerated zone, means for providing refrigerated binary refrigerant including a compressor and condenser, a first evaporator in heat transfer association with said below-freezing refrigerated zone, a second evaporator in heat transfer association with said above-freezing refrigerated zone, a first heat exchanger, a second heat exchanger, and refrigerant flow conduit means providing a flow circuit successively through said first heat exchanger, said second heat exchanger, said first evaporator, said second heat exchanger in heat exchange relationship with the refrigerant flowing therethrough to said first evaporator, said second evaporator and said first heat exchanger in heat exchange relationship with the refrigerant flowing therethrough to said second heat exchanger, to said compressor, the improvement comprising:

means for concurrently increasing the cooling effect in one zone while decreasing the cooling effect in the other zone in response to the temperature of said one zone rising above a first preselected temperature; and means for automatically adjusting the ratio of the components of the binary refrigerant for increasing the refrigerating capacity of the apparatus as an incident of the increasing of the cooling effect in said one zone being insufficient to prevent the temperature in said one zone from rising to a second preselected temperature above said first preselected temperature.

21. The refrigeration apparatus of claim 20 wherein said means for increasing the refrigerating capacity of the apparatus is arranged to increase the capacity of the apparatus in the event the temperature of said other zone rises above a third preselected temperature as a result of said decreasing of the cooling effect therein.

22. The refrigeration apparatus of claim 20 wherein a preselected phase change material is provided to increase the thermal capacity of said zones.

* * * * *